United States Patent [19]

Olin et al.

[11] Patent Number: 4,613,856

[45] Date of Patent: Sep. 23, 1986

[54] CHARACTER AND VIDEO MODE CONTROL CIRCUIT

[75] Inventors: Daniel C. Olin, Portland; Russell Y. Anderson, Hillsboro; Steven C. DenBeste, Beaverton, all of Oreg.

[73] Assignee: Tektronix, Inc., Beaverton, Oreg.

[21] Appl. No.: 481,557

[22] Filed: Apr. 4, 1983

[51] Int. Cl.[4] ..... G09G 1/00

[52] U.S. Cl. ..... 340/723; 340/735; 340/745; 340/703

[58] Field of Search ..... 340/723, 748, 750, 721, 340/745, 703

[56] References Cited

U.S. PATENT DOCUMENTS

| | | | |
|---|---|---|---|
| 3,603,966 | 9/1971 | Gregg | 340/748 |
| 3,909,792 | 9/1975 | Harris | 340/721 |
| 4,297,693 | 10/1981 | Parsons | 340/721 |
| 4,398,190 | 8/1983 | Long | 340/723 |
| 4,408,198 | 10/1983 | Kudirka | 340/748 |
| 4,429,306 | 1/1984 | Macanley | 340/735 |

*Primary Examiner*—Marshall M. Curtis

*Attorney, Agent, or Firm*—Robert S. Hulse; John Smith-Hill; Fancis I. Gray

[57] ABSTRACT

An electrical circuit is described that requires a reduced number of data bits for character-address and video-mode information by using a predetermined bit combination of the video-mode information as part of the character-address information. Character-address and video-mode information is output from a random access memory (RAM) to a character read only memory (ROM) and a video-mode detection circuit that produces outputs to enable video-mode circuits in the video control circuitry. One output of the video-mode detection circuit is coupled to an address input of the character ROM that has characters divided into two character sets. A predetermined bit combination of the video-mode information produces an output from the video-mode detection circuit that selects one of the character sets while the other bit combinations produce an output from the detection circuit that selects the other character set. In this way, character-address and video-mode information having n data bits can produce character and video-mode outputs that normally require n+1 data bits.

7 Claims, 3 Drawing Figures

CHARACTER ROM
$C_{OUT}$ 0-7
S/R
G
S
$L_2$-$L_0$
$D_{OUT}$ 0-5
$D_{OUT}$ 6
$D_{OUT}$ 7
28
Q1
Q2
D1
D2
CLR
$D_{IN}$ 0-7
$D_{OUT}$ 0-7
DISPLAY RAM
$X_5$-$X_0$
$X_{10}$-$X_6$
ADDRESS GENERATOR
V
H
TIMING
HORIZONTAL DEFLECTION DRIVER
VERTICAL DEFLECTION DRIVER
HORIZONTAL TIMING
VERTICAL TIMING

CHARACTER AND VIDEO MODE CONTROL CIRCUIT

BACKGROUND OF THE INVENTION

The present invention relates to an electrical circuit for use in an electrical display device that uses coded electrical signals to produce characters and video effects on an output display.

Raster scan type cathode-ray tube (CRT) display devices produce flicker free displays containing a great deal of information composed of many kinds of characters and images. These devices also produce various video modes, such as normal video (i.e. intensified characters on a dark background), reverse video (i.e. dark characters on an intensified background), or highlighting (i.e. half intensity shading of characters).

Raster scan type CRT displays that are used for displaying alphanumeric information are generally divided into a matrix of M rows and N columns. Each coordinate of the $M \times N$ display matrix defines a character location on the display and is subdivided into a $p \times q$ character matrix that defines pixel location on the display. A character read only memory (ROM) stores a plurality of electrical patterns, representative of character information, in $p' \times q'$ matrices corresponding in size to the $p \times q$ matrices of the $M \times N$ display matrix. A display random access memory (RAM) stores charcter-address and character-attribute information corresponding to the coordinates of the $M \times N$ display matrix in separate memory locations. In the above type display, the character-attribute information defines the various video-modes.

To produce a display on the CRT, the display RAM outputs character-address and video-mode information in synchronization with the raster scan operation of the display device. When addressed by the display RAM, the character ROM outputs a corresponding electrical pattern, representative of character information to the video display circuitry. Concurrently, the video-mode information is coupled to the video display circuitry to enable the appropriate video mode circuits. The output of the video display circuitry is coupled to the Z-axis control grid of the CRT to produce the output display.

Display RAMs and character ROMs are used in raster scan type CRT display devices to reduce circuit cost and memory size. However, limitations are placed on the circuit by the display RAM word size in relation to the total number of characters stored in the character ROM and the number of video modes desired. For example, a display device may use a display RAM that stores data in 8 bit words and a character ROM capable of storing 128 characters. The display device also may provide three video modes, such as normal and reverse video and highlighting. Seven bit character-address information is required to access the 128 characters in the character ROM and 2-bit video mode information is required to enable the three video mode circuits. Since the display RAM stores data in 8 bit words, the character-address and video-mode information must be stored in separate memory locations, thereby increasing the size of the display RAM. This limitation can be overcome by increasing the word size of the display RAM, or decreasing the number of characters stored in the character ROM or decreasing the number of video modes, all of which are undesirable.

SUMMARY OF THE INVENTION

The present invention is directed toward an electrical circuit that uses coded electrical signals, such as character-address and character-attribute information, to produce character images and video effects on an output display of an electrical display device. The electrical circuit requires a reduced number of data bits for character-address and character-attribute information by using predetermined bit combinations of the character-attribute information as part of the character-address information. In the preferred embodiment, a display random access memory (RAM) simultaneously outputs character-address and character-attribute information, also called video-mode information, that respectively address a character read only memory (ROM), having two addressable character sets, and a video-mode detection circuit, composed of gates, latches, or the like. The video-mode detection circuit produces an output that addresses the character ROM and other outputs that enable video-mode circuits, such as normal video (i.e. intensified characters on a dark background), reverse video (i.e. dark characters on an intensified background), highlighting (i.e. half intensity shading of characters), or the like. Certain bit patterns of the video-mode information produce outputs from the video-mode detection circuit that address one of the character sets in the character ROM and enable selected video-mode circuits. A predetermined bit pattern of the video-mode information produces an output from the video-mode detection circuit that addresses the second character set while maintaining the previous video mode. In this way, character-address and video-mode information having n data bits can produce character and video mode outputs that normally require $n+1$ data bits.

A more complete understanding of the present invention and its various features, advantages, and objectives may be had by referring to the following detailed description and the accompanying drawings.

A BRIEF DESCRIPTION OF THE DRAWINGS

DETAILED DESCRIPTION OF THE INVENTION

The present invention relates to an electrical display device having an electrical circuit that uses coded electrical signals, such as character-address and character-attribute information, to produce characters and video effects on an output display. As described in this embodiment, the electrical display device is a raster scan type cathode ray tube (CRT) display.

Figure 1:
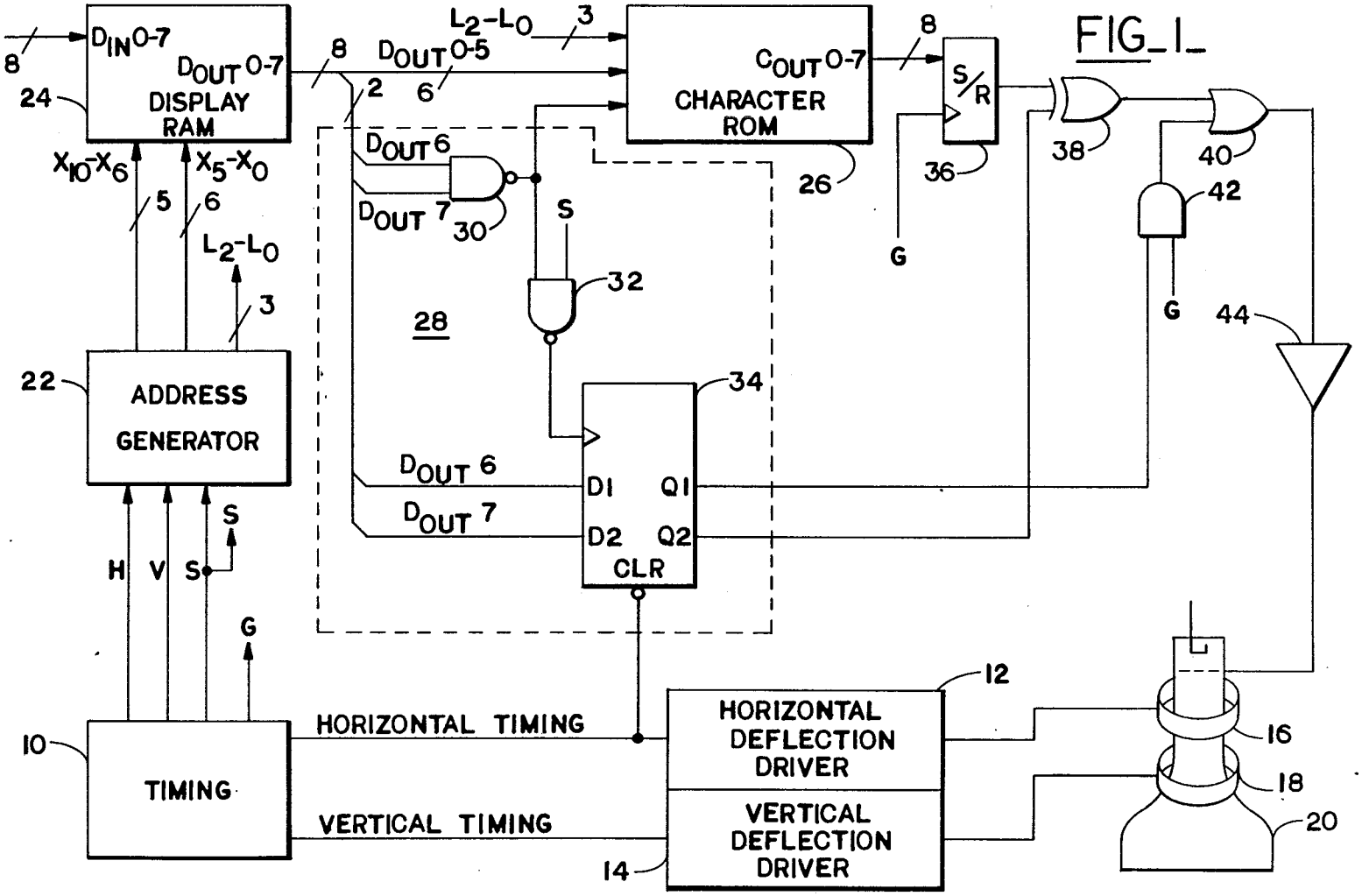
FIG. 1 is a block diagram of a portion of an electrical display device employing the electrical circuit of the present invention.

Referring to FIG. 1 there is shown a block diagram of a portion of a raster scan type CRT display device employing the electrical circuit of the present invention. Timing block 10 contains timing circuits that produce horizontal and vertical timing pulses that are coupled to horizontal and vertical deflection drivers 12 and 14. Deflection drivers 12 and 14 produce ramping signals that are coupled to horizontal and vertical deflection yokes 16 and 18 on CRT 20 to produce a series of horizontal raster lines on the face of the CRT. The circuits thus far described are conventional and are well known in the art.

Horizontal and vertical timing pulses are also coupled from timing block 10 to address generator 22. Horizontal timing pulses are coupled from timing block 10 to the clear input of data latch 34. Timing block 10 also contains circuits that produce a character frequency signal S that is coupled to address generator 22 and to one input of NAND gate 32. Additional circuits in timing block 10 produce a dot frequency signal G that is coupled to the clock input of a parallel to serial shift register 36 and to one input of AND gate 42.

The address generator 22 is coupled to a display random access memory (RAM) 24 via address lines $X_0$–$X_{10}$. A second set of address lines $L_0$–$L_2$ couple the address generator 22 to address inputs of a character read only memory (ROM) 26. The display RAM 24 is coupled to receive data on data in lines $D_{in}$0–7 and output data on data out lines $D_{out}$0–7. Data out lines $D_{out}$0–5 are coupled to address inputs of the character ROM 26 and data out lines 6 and 7 are coupled to the inputs of NAND gate 30 and to the $D_1$ and $D_2$ inputs of data latch 34. The output of NAND gate 30 is coupled to an address input of the character ROM 26 and to one input of NAND gate 32. As previously stated, the second input to NAND gate 32 is the character frequency signal S from timing block 10. The output of NAND gate 32 is coupled to the clock input of data latch 34. NAND gate 30, NAND gate 32, and data latch 34 form the video-mode detection circuit 28.

The character ROM 26 is coupled to a parallel to serial shift register 36 via character out lines $C_{out}$0–7. As previously stated, shift register 36 is clocked by the dot frequency signal G from timing block 10. The output of the shift register 36 is coupled to one input of exclusive OR gate 38 that has its second input coupled to the $Q_2$ output of latch 34. The output of exclusive OR gate 38 is coupled to one input of OR gate 40 that has its second input coupled to the output of AND gate 42. One input of AND gate 42 is coupled to the $Q_1$ output of latch 34 while the second input is coupled to receive the dot frequency signal G from timing block 10. The output of OR gate 40 is coupled to a buffer amplifier 44 whose output is coupled to the Z-axis control grid of CRT 20. So as to more fully understand the electrical circuit of the present invention, a description of a raster scan type CRT display containing alphanumeric information will be given.

Figure 3:
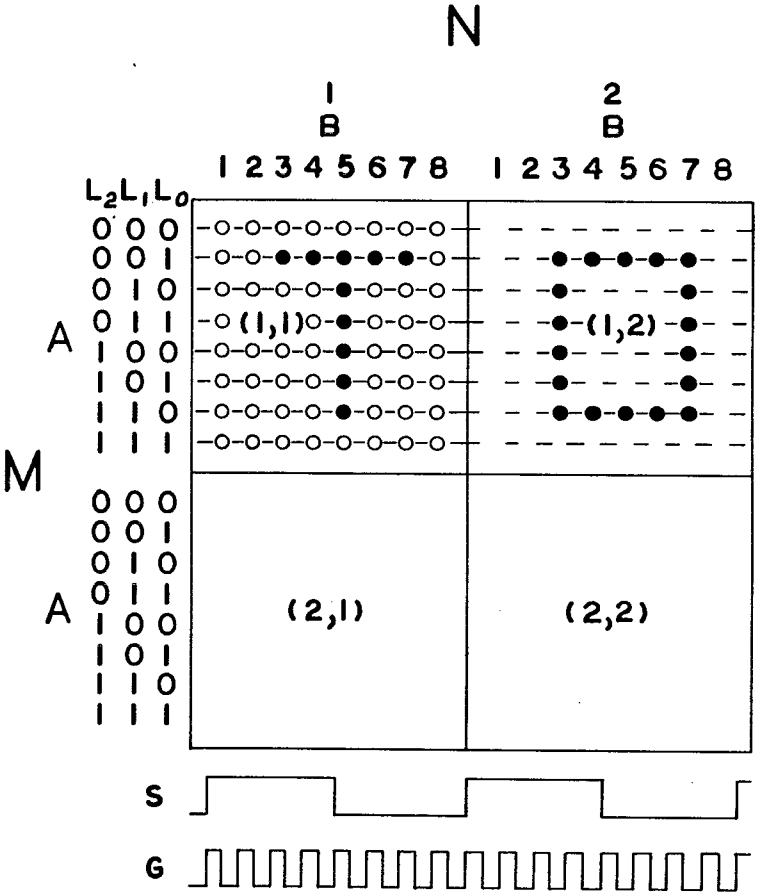
FIG. 3 is an expanded view of the CRT display of FIG. 2 showing the relationships between the $M \times N$ display matrix, an $A \times B$ character matrix and various electrical signals and addresses within the display device.
Figure 2:
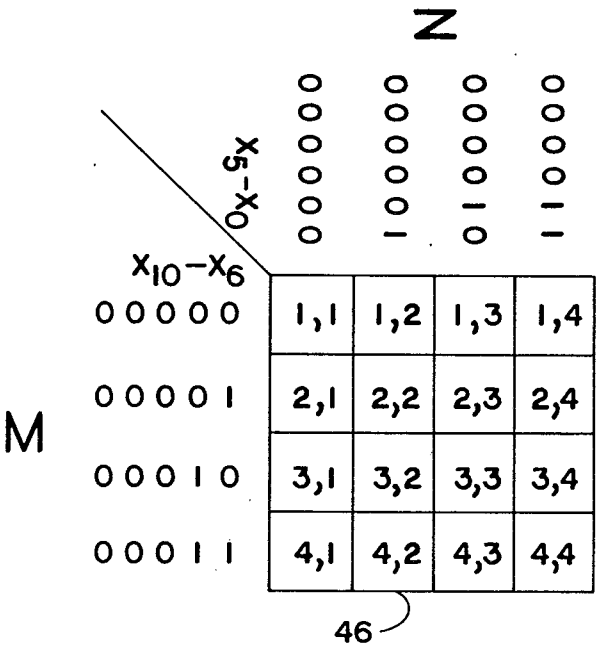
FIG. 2 shows a portion of a CRT display divided into a matrix of M rows and N columns.

Referring to FIG. 2, there is shown a portion of a raster scan type CRT display 46 that is used for presenting alphanumeric information. CRT display 46 is similar to the display produced on CRT 20 of FIG. 1. CRT display 46 is divided into a matrix of M rows and N columns. As shown in FIG. 3, each display matrix coordinate (e.g. 1,1; 1,2; 2,1; 3,2 is subdivided into a A×B character matrix. Each A row of the character matrix corresponds to a raster line on CRT display 46 and the B coordinates correspond to pixel points on the same display. In this embodiment, the display matrix M×N is defined as having 30 rows and 64 columns and the character matrix A×B is defined as having 8 rows and 8 columns. Therefore, CRT display 46 is composed of 240 raster lines (30 M rows×8 A rows) with each raster line having 512 pixel points (64 N columns×8 B columns) and the total display having 122,880 pixel points (240 raster lines×512 pixel per line). For clarity of the drawing, only display matrix coordinate (1,1) shows all the pixel points of character matrix A×B.

It can be seen from FIG. 3 that each display matrix coordinate is composed of 8 raster lines and 64 pixel points. From the previous description, it is known that each raster line contains 512 pixel points and that each line is divided into 64 character columns. Therefore, to produce one display matrix row, (M), of characters on CRT display 46, it is necessary to sequentially repeat 8 times all of the column coordinates, (N), of the M×N display matrix while maintaining the same row coordinate. (M). This corresponds to the production of 8 raster lines on CRT display 46. This concept is important with respect to display RAM 24 addressing because each memory location in display RAM 24 of FIG. 1 corresponds to coordinates of the M×N display matrix on CRT display 46. Display RAM 24 addressing will be described in more detail below.

Referring again to FIG. 1, address generator 22 produces display RAM 24 and character ROM 26 addresses in response to horizontal and vertical timing pulses and the character frequency signal S from timing block 10. The character frequency signal S is a function of the number character, (N), per display matrix row, (M), divided by the trace time of one raster line across the CRT display 46. For example, if the total time between horizontal timing pulses is 64 μsec and there are 64 characters, (N), per display matrix row, (M), as is the case in this embodiment, then the character frequency must be equal to or greater than 1 MHZ. The character frequency is set greater than the minimum frequency to allow for horizontal flyback and stabilization of the circuit. In this embodiment, character frequency signal S will be set at 1.2 MHZ.

The dot frequency signal G is a function of the character frequency signal S times the number of pixel points, (B), per character matrix row, (A). In this embodiment, there are 8 pixel points per character matrix row, (A), and the character frequency signal S is 1.2 MHZ. Therefore, the dot frequency signal G is 9.6 MHZ.

Address lines $X_0$–$X_{10}$ couple the address generator 22 to the display RAM 24. The address lines $X_0$–$X_{10}$ can be divided into two sets with address lines $X_0$–$X_5$ corresponding to column coordinates, (N), of the M×N display matrix as shown in FIG. 2 and address lines $X_6$–$X_{10}$ corresponding to row coordinates, (M), of the same display matrix. Address lines $L_0$–$L_2$ couple a raster line count from address generator 22 to character ROM 26 as shown in FIG. 1. The addresses on lines $X_0$–$X_5$ are produced in response to the 1.2 MHZ character frequency signal S and the addresses on line $L_0$–$L_2$ and lines $X_6$–$X_{10}$ are produced in response to the horizontal timing pulses, with line $L_0$ being the least significant bit as shown in FIG. 3 and line $X_{10}$ being the most significant bit as shown in FIG. 2. The vertical timing pulses can be used to reset the $L_0$–$L_2$ and the $X_6$–$S_{10}$ addresses before the initiation of each new raster display.

Display RAM 24 receives character-address and character-attribute information from various input devices, such as a keyboard, program firmware or the like, via data on lines $D_{in}$0–7. In this embodiment, the display RAM 24 is an 8 bit RAM and the character-address information is supplied to RAM 24 on data in lines $D_{in}$0–5 and the character-attribute information, also called video-mode information, is supplied on data in lines $D_{in}$6 and 7. The character-address and video-mode information is stored in th display RAM 24 at memory locations corresponding to the coordinates of the CRT display matrix M×N of FIG. 2.

The display RAM 24 outputs the stored character-address and video-mode information in response to addresses supplied by the address generator 22. The 6 bit character-address information is output on data out lines $D_{out}$0–5 and the 2 bit video-mode information is output on data out lines $D_{out}$6 and 7. The character-address information addresses the character ROM 26 that has electrical patterns, representative of character information, contained in A'×B' matrices corresponding to the A×B character matrices shown in FIG. 3. The character information within the character ROM 26 is divided into two addressable character sets, each set having a maximum of 64 characters. The character-address information addresses all of the characters in the character sets and an output of the video-mode detection circuit addresses the character sets. The video-mode information addressess the video-mode detection circuit 28 comprising NAND gate 30, latch 34, and NAND gate 32. In this embodiment, the video modes are normal video (i.e. intensified character on a dark background), reverse video (i.e. dark character on an intensified background), and highlighting (i.e. half intensity shading of characters). The video-mode detection circuit 28 will be described in greater detail below.

As shown in FIGS. 1 and 3, the character ROM 26 receives a repeating raster line count from the address generator 22 via address lines $L_0$–$L_2$. Character matrix A'×B' data is output from the character ROM 26 in response to character-address and raster line information on address lines $D_{out}$0–5 and $L_0$–$L_2$ respectively. One character matrix row A' is output for each change in character-address information and 64 character matrix rows, 64×A' are output for each change of raster line information. The output of character ROM 26 is coupled via character out lines $C_{out}$0–7 to a parallel to serial shift register 36. The shift register 36 converts the parallel character matrix row data, (A'), into serial data in response to the dot frequency signal G applied to clock input of the shift register. As will be remembered, the dot frequency signal G is a 9.6 MHZ signal that is the product of the 1.2 MHZ character frequency signal S and the number of pixel points, (B), per character matrix row, (A).

The output of shift register 36 is coupled to one input of exclusive OR gate 38. The second input of exclusive OR gate 38 is coupled to the $Q_2$ output of latch 34 that is a part of the video-mode detection circuit 28. The output of exclusive OR gate 38 is coupled to one input of OR gate 40. The second input of OR gate 40 is coupled to the output of AND gate 42. One input of AND gate 42 is coupled to the $Q_1$ output of latch 34 of the video-mode detection circuit 28 and the second input is coupled to receive the dot frequency signal G from the timing block 10. The output of OR gate 40 is coupled to a buffer amplifier 42 that amplifies the video signal and couples the signal to the Z axis control grid of CRT 20 to produce a video display during raster scan operation.

Returning now to the video-mode detection circuit 28, video-mode information is coupled from the display RAM 24 via data out lines 6 and 7 to the video-mode detection circuit. Lines 6 and 7 are coupled to the inputs of NAND gate 30 and to the $D_1$ and $D_2$ inputs of latch 34. The output of NAND gate 30 is coupled to an address input of character ROM 26 and to the enable input of NAND gate 32. The second input of NAND gate 32 is coupled to receive the 1.2 MHZ character frequency signal S from the timing block 10. The output of NAND gate 32 is coupled to the clock input of latch 34. As long as the output of NAND gate 30 is high, the output of NAND gate 32 will be a 1.2 MHZ clock pulse to latch 34. The clocking of latch 34 is synchronized to the changes in addresses $X_0$–$X_5$ from address generator 22 that correspond to the column coordinates of the M×N display matrix. The $Q_1$ output of latch 34 is coupled to the enable input of AND gate 42 to initiate video mode highlighting. The $Q_2$ output of latch 34 is coupled to exclusive OR gate 38 to produce reverse video.

In the following description, the video-mode information will be defined as follows:

TABLE 1

| 2-Bit Video-Mode Information line 7 | line 6 | (Video Modes) | Character set in Character ROM |
|---|---|---|---|
| 0 | 0 | Normal Video | 1 |
| 0 | 1 | Highlighting | 1 |
| 1 | 0 | Reverse Video | 1 |
| 1 | 1 | Continue the Previous Video Mode | 2 |

In the first case where the video-mode information on data out lines 6 and 7 are binary 0's, the output of NAND gate 30 is a binary 1 that addresses one of the character sets in character ROM 26, and enables NAND gate 32. The enabling of NAND gate 32 couples the 1.2 MHZ character frequency signal S to the clock input of latch 34. The clocking of latch 34 couples the binary 0's at the $D_1$ and $D_2$ inputs to the $Q_1$ and $Q_2$ outputs.

The binary 0's at $Q_1$ and $Q_2$ outputs are coupled to the exclusive OR gate 38 and to the enable input of AND gate 42 respectively. A binary 0 on the input of exclusive OR gate 38 has no effect on its output and a binary 0 on the enable input of AND gate 42 prevents the 9.6 MHZ dot frequency signal G from passing through the gate. Therefore, normal video is supplied to CRT 20.

When the video-mode information on data out lines 6 and 7 are respectively 1 and 0, the output of NAND gate 30 is still a binary 1 and the $D_1$ and $D_2$ inputs of latch 34 are respectively 1 and 0. One character from the same character set as before is selected from the character ROM 26 and the 1.2 MHZ character frequency signal S is coupled through NAND gate 32 to clock latch 34. The $Q_1$ and $Q_2$ outputs of latch 34 now have a 1 and 0 respectively. The $Q_2$ output is the same as before so the exclusive OR gate 38 is not affected. The binary 1 at the $Q_1$ output of latch 34 enables AND gate 42 which passes the 9.6 MHZ dot frequency signal G to OR gate 40. The video signal from exclusive OR gate 38 is OR'ed with the 9.6 MHZ dot frequency signal G in OR gate 40 to increase the average level of the video output, thereby highlighting that portion of the display.

When the video-mode information on data out lines 6 and 7 are respectively 0 and 1, the output of NAND gate 30 is again a binary 1 and the $D_1$ and $D_2$ inputs of latch 34 are respectively 0 and 1. Another character from the same character set as before is selected from character ROM 26 and NAND gate 32 couples the 1.2 MHZ clock frequency signal to clock latch 34. After the latch has clocked, the $Q_1$ and $Q_2$ outputs are respectively 0 and 1. The 0 output at $Q_1$ is coupled to the enable input of AND gate 42 to prevent the coupling of the 9.6 MHZ dot frequency singal G to OR gate 40. The 1 output of $Q_2$ is coupled to one input of exclusive OR gate 38 which causes the data on the other input to be reversed at the output. Thus, the reverse video mode is achieved.

When the video-mode information on data out lines 6 and 7 are binary 1's, the output of NAND gate 30 becomes a binary 0. A binary 0 on the output of NAND gate 30 causes a character from the second character set in the character ROM 26 to be chosen and prevents the 1.2 MHZ character frequency signal from coupling through NAND gate 32 to clock latch 34. Since latch 34 has not been clocked, the previous outputs at $Q_1$ and $Q_2$ remain the same, thereby maintaining the previous video mode.

Latch 34 is cleared by a horizontal timing pulse after each raster line to prevent latched video-mode information on one raster line from interfering with different video-mode information on the next raster line. It should be noted that video modes cannot be changed while addressing a character from the second character set of character ROM 26. This is due to the latching of the video-mode detection circuit 28 to the previous video mode by the predetermined 2-bit video-mode information that also defines the selection of the second character of character ROM 26. In order to change video modes for a character from the second character set, it is necessary to unlatch detection circuit 28 before re-addressing the second character set. This is accomplished by entering new video-mode information with attendant character-address information that unlatches the video-mode detection circuit and defines the new video mode. This also causes the video-mode detection circuit 28 to address the first character set of character ROM 26. To minimize this problem, it is necessary to carefully choose the characters for each character set.

The electrical circuit of the present invention has been described using character-address and video-mode information requiring an 8 bit data path. The present invention may equally well use character-address and video-mode information requiring larger or smaller data paths, thus requiring larger or smaller RAMs and ROMs. Additionally, character-address and video-mode information may be structured in any combination thus permitting more character sets in the character ROM and more video modes. The character ROM may also contain other types of information, such as timing diagrams or the like, in addition to alphanumeric information. The present invention is not restricted to raster scan type CRT display devices and may be applied to vector display systems or the like.

The terms and expressions which have been used in the foregoing specification are used therein as terms of description and not of limitation, and there is no intention, in the the use of such expressions, of excluding equivalents of the features shown and described or portions thereof, it being recognized that the scope of the invention is defined and limited only by the claims which follow.

We claim:

1. An electrical circuit comprising:

means for storing a plurality of sets of electrical patterns, each of said electrical patterns representative of character information and each set of electrical patterns defining a corresponding character set, said storing means coupled to receive a first portion of a coded electrical signal and at least one control signal to produce an output electrical signal representative of character information; and means for detecting a second portion of said coded electrical signal to produce said at least one control signal coupled to said storing means, said at least one control signal selecting one of said sets of electrical patterns, one of said electrical patterns within said selected one of said sets of electrical patterns being selected by said first portion of said coded electrical signal, and to produce additional control signals representative of character attributes.

2. The electrical circuit of claim 1 wherein said storage means is a read only memory (ROM) storing electrical patterns addressable by said first part of coded electrical signal and said control signal.

3. The electrical circuit of claim 1 wherein said detection means comprises a first and a second NAND gate and a data latch such that said second portion of coded electrical signal is coupled to the inputs of said first NAND gate and to the data inputs of said data latch.

4. The detection means of claim 3 wherein the output of said first NAND gate is said control signal coupled to said storage means and the outputs of said data latch are the additional control signals representative of character attributes.

5. The electrical circuit of claim 1 further comprising means for selectively modifying said output electrical signal according to said additional control signals representative of character attributes after said output electrical signal is produced by said means for storing, thereby changing an attribute of the character information said output electrical signal represents.

6. An electrical circuit comprising:

means for storing a plurality of sets of electrical patterns, each of said electrical patterns representative of character information and each set of electrical patterns defining a corresponding character set, said storing means coupled to receive a first portion of a coded electrical signal and at least one control signal to produce a set of parallel binary output bits;

means for converting said parallel binary output bits to a first sequence of binary bits representative of character information;

means for detecting a second portion of said coded electrical signal to produce said at least one control signal coupled to said storing means, said at least one control signal selecting one of said sets of electrical patterns, one of said electrical patterns within said selected one of said sets of electrical patterns being selected by said first portion of said coded electrical signal, and to produce additional control signals representative of character attributes; and means for selectively changing states of said first sequence of binary bits according to a first of said additional control signals, thereby changing a first attribute of the character information represented by said first sequence of binary bits.

7. The electrical circuit of claim 6 further comprising:

means for generating a second sequence of binary bits representative of character attribute information; and means for selectively combining said first sequence of binary bits with said second sequence of binary bits according to a second of said additional control signals, thereby changing a second attribute of the character information represented by said first sequence of binary bits.

* * * * *